US009068458B2

(12) United States Patent
Ota et al.

(10) Patent No.: US 9,068,458 B2
(45) Date of Patent: Jun. 30, 2015

(54) SHOCK PROTECTOR FOR A COMPRESSOR'S DRIVE CIRCUIT

(75) Inventors: Takayuki Ota, Kariya (JP); Ken Suitou, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 306 days.

(21) Appl. No.: 13/431,533

(22) Filed: Mar. 27, 2012

(65) Prior Publication Data

US 2012/0251356 A1 Oct. 4, 2012

(30) Foreign Application Priority Data

Mar. 31, 2011 (JP) ..... 2011-077042

(51) Int. Cl.

| | |
|---|---|
| ***F04C 29/06*** | (2006.01) |
| ***F04C 29/00*** | (2006.01) |
| ***F01C 21/10*** | (2006.01) |
| ***F01C 21/00*** | (2006.01) |

(Continued)

(52) U.S. Cl.

CPC ..... *F01C 21/10* (2013.01); *F04C 29/066* (2013.01); *F04C 29/0021* (2013.01); *F04C 18/0215* (2013.01); *F04C 23/008* (2013.01); *F04C 2240/30* (2013.01); *F04C 2240/80* (2013.01); *F04C 2270/12* (2013.01); *F04C 2270/19* (2013.01); *F01C 21/007* (2013.01); *F04C 28/28* (2013.01); *F04C 29/04* (2013.01); *F04C 2270/13* (2013.01); *F05C 2251/048* (2013.01)

(58) Field of Classification Search

CPC ..... F04C 5/00; F04C 23/008; F04C 29/04; F04C 29/063; F04C 29/065; F04C 29/066; F04C 29/068; F04C 28/28; F04C 2240/30; F04C 2240/805; F04C 2270/12; F04C 2270/125; F04C 15/0042; F04C 29/0021

USPC ..... 417/357, 371, 373, 423.8, 423.15, 417/423.14, 363

See application file for complete search history.

(56) References Cited

U.S. PATENT DOCUMENTS 4,184,810 A * 1/1980 Dyhr et al. ..... 417/363
5,480,289 A * 1/1996 Lee ..... 417/360

(Continued)

FOREIGN PATENT DOCUMENTS

JP 5-65876 A 3/1993
JP 6-288353 A 10/1994

(Continued)

*Primary Examiner* — Bryan Lettman
*Assistant Examiner* — Timothy P Solak
(74) *Attorney, Agent, or Firm* — Sughrue Mion, PLLC

(57) ABSTRACT

A motor-driven compressor that prevents electric leakage from a drive circuit while suppressing the generation of noise. The motor-driven compressor includes a compressor mechanism that compresses a refrigerant, a motor mechanism that actuates the compressor mechanism, a drive circuit that drives the motor mechanism. The drive circuit is connected to a power supply. An inner housing accommodates the compressor mechanism and the motor mechanism in a sealed state and holds the drive circuit. An outer housing accommodates the inner housing and includes a mounting portion that can be mounted to another member. An intermediate member arranged between the inner housing and the outer housing and between the drive circuit and the outer housing. The intermediate members include anti-vibration and thermal insulation properties. A protector protects the drive circuit from an external impact, wherein the protector is arranged on the outer housing.

9 Claims, 5 Drawing Sheets

(51) Int. Cl.

| | |
|---|---|
| ***F04C 28/28*** | (2006.01) |
| ***F04C 29/04*** | (2006.01) |
| *F04C 18/02* | (2006.01) |
| *F04C 23/00* | (2006.01) |

(56) References Cited

U.S. PATENT DOCUMENTS

| | | | | |
|---|---|---|---|---|
| 5,567,133 | A * | 10/1996 | Kobaybashi et al. | 417/423.7 |
| 5,997,258 | A * | 12/1999 | Sawyer et al. | 417/312 |
| 6,619,933 | B2 * | 9/2003 | Ikeda | 417/410.1 |
| 7,112,045 | B2 * | 9/2006 | Kimura et al. | 417/371 |
| 2005/0158185 | A1 * | 7/2005 | Herrick et al. | 417/360 |
| 2005/0274569 | A1 * | 12/2005 | Seel | 181/202 |

FOREIGN PATENT DOCUMENTS

| | | | |
|---|---|---|---|
| JP | 8-261150 | A | 10/1996 |
| JP | 11-294365 | A | 10/1999 |
| JP | 2007-16601 | A | 1/2007 |
| JP | 2008-82266 | A | 4/2008 |
| JP | 2009-103100 | A | 5/2009 |
| JP | 2009-221969 | A | 10/2009 |
| WO | 2009/004766 | A1 | 1/2009 |

* cited by examiner

SHOCK PROTECTOR FOR A COMPRESSOR'S DRIVE CIRCUIT

BACKGROUND OF THE INVENTION

The present invention relates to a motor-driven compressor.

Japanese Laid-Open Patent Publication No. 2009-103100 discloses a motor-driven compressor of the prior art. The motor-driven compressor is included in an air conditioner, which is installed in a vehicle. The motor-driven compressor includes a housing, a compressor mechanism, a motor mechanism, and a drive circuit. The housing includes a mounting portion that can be mounted to an engine. The compressor mechanism is arranged in the housing, draws refrigerant into the housing, compresses the refrigerant, and discharges the refrigerant from the housing. The motor mechanism is arranged in the housing and actuates the compressor mechanism. The drive circuit is connected to a power supply and drives the motor mechanism. Further, the drive circuit is held on an outer portion of the housing.

In the motor-driven compressor of the prior art, during a vehicle collision, the mounting portion may break and the housing may approach the engine. In such a case, a projection, which is arranged on the outer portion of the housing, first interferes with the engine so that the drive circuit does not interfere with the engine. This prevents damage to the drive circuit and prevents electric leakage from the drive circuit.

In the motor-driven compressor of the prior art, to ensure prevention of electric leakage from the drive circuit, a plate-shaped protector that covers the drive circuit may be coupled to the outer portion of the housing. In such a case, however, the protector may resonate and generate noise due to vibration from the compressor mechanism and motor mechanism in the housing.

SUMMARY OF THE INVENTION

Accordingly, it is an object of the present invention to provide a motor-driven compressor that prevents electric leakage from a drive circuit while suppressing the generation of noise.

One aspect of the present invention is a motor-driven compressor including a compressor mechanism that compresses a refrigerant. A motor mechanism actuates the compressor mechanism. A drive circuit drives the motor mechanism. The drive circuit is connected to a power supply. An inner housing accommodates the compressor mechanism and the motor mechanism in a sealed state and holds the drive circuit. An outer housing accommodates the inner housing. The outer housing includes a mounting portion that can be mounted to another member. Intermediate members are arranged between the inner housing and the outer housing and between the drive circuit and the outer housing. The intermediate members include anti-vibration and thermal insulation properties. A protector that protects the drive circuit from an external impact. The protector is arranged on the outer housing.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First to third embodiments of the present invention will now be described with reference to the drawings.

First Embodiment

Figure 1:
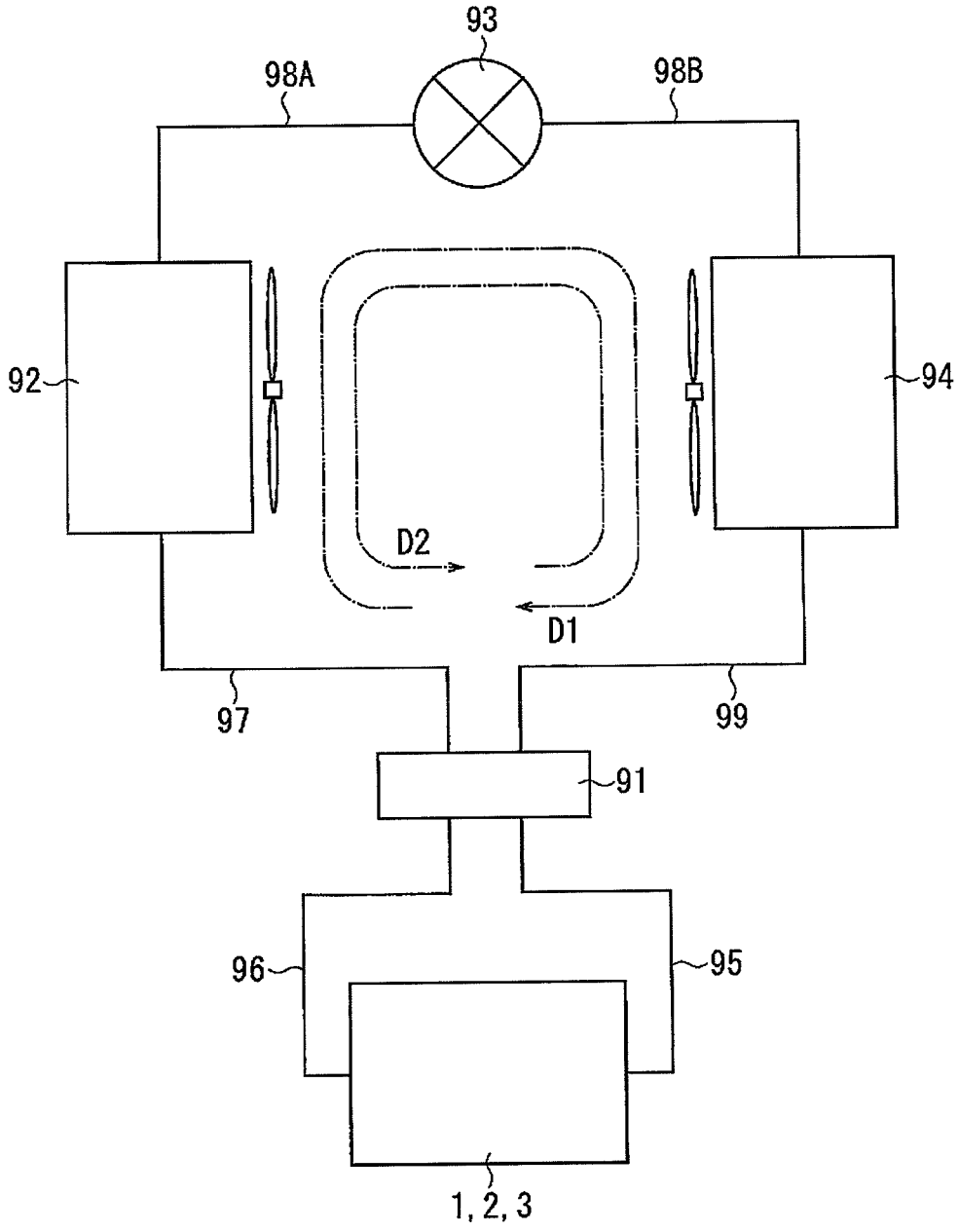
FIG. 1 is a block diagram of an air conditioner including a motor-driven compressor according to a first embodiment of the present invention.

Referring to FIG. 1, a motor-driven compressor 1 of the first embodiment is applied to an air conditioner installed in a vehicle to adjust the temperature of a passenger compartment. In addition to the motor-driven compressor 1, the air conditioner includes a switch valve 91, a passenger compartment exterior heat exchanger 92, an expansion valve 93, and a passenger compartment interior heat exchanger 94.

Figure 2:
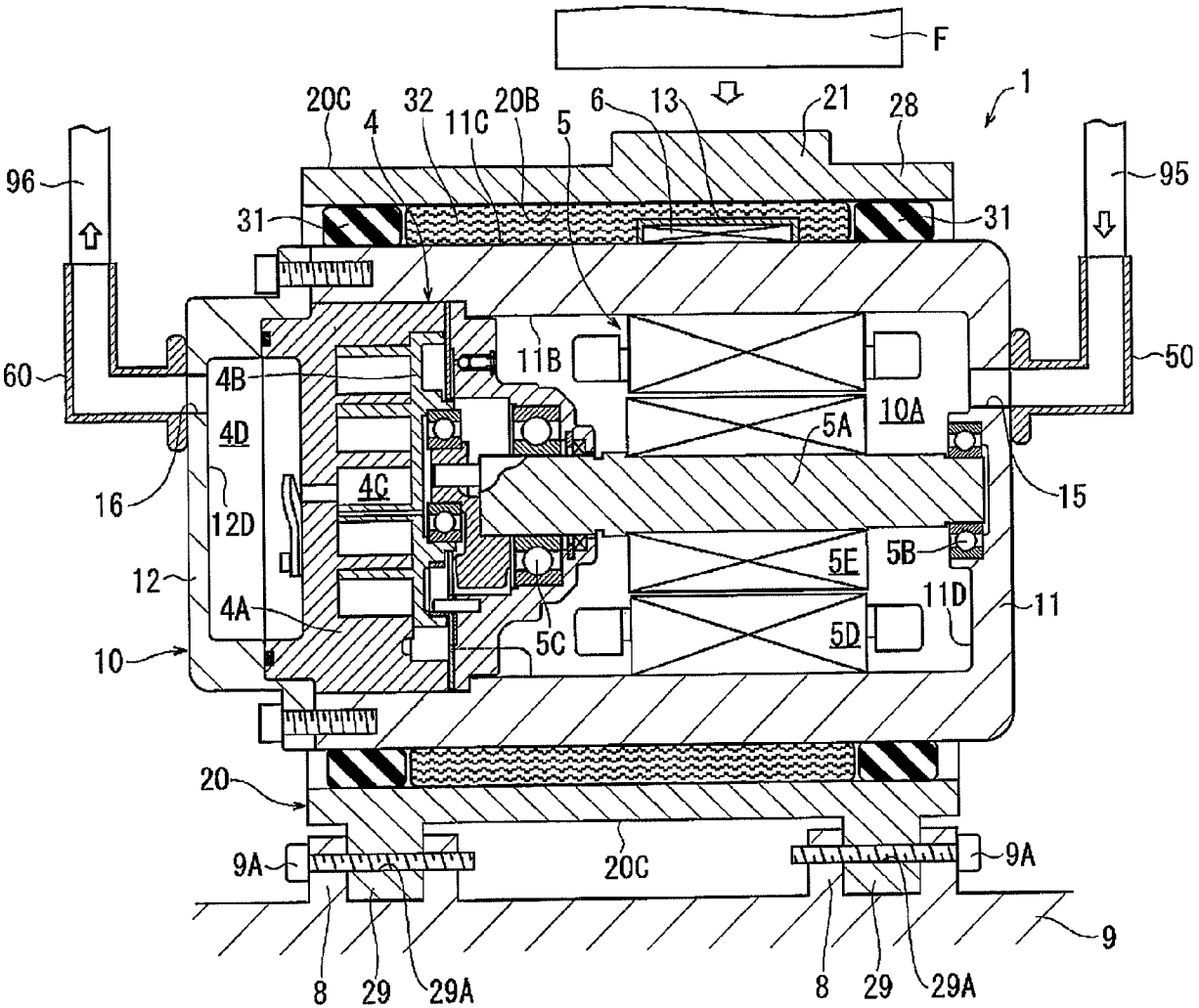
FIG. 2 is a cross-sectional view of the motor-driven compressor of the first embodiment.

As shown in FIG. 2, the motor-driven compressor 1 includes a compressor mechanism 4, a motor mechanism 5, a drive circuit 6, an inner housing 10, and an outer housing 20. The inner housing 10 accommodates the compressor mechanism 4 and the motor mechanism 5 in a sealed state. The outer housing 20 accommodates the inner housing 10.

In the present embodiment, the inner housing 10 includes a first housing 11, which includes an open rear end (left end as viewed in FIG. 2), and a second housing 12, which closes the rear end of the first housing 11. The compressor mechanism 4 includes a fixed scroll 4A, which is fixed to an inner circumferential surface 11B of the first housing 11, and a movable scroll 4B, which is arranged to face the fixed scroll 4A. The fixed scroll 4A and movable scroll 4B are engaged with each other and form a compression chamber 4C. A drive shaft 5A is accommodated in the first housing 11. The drive shaft 5A includes a distal portion (right side as viewed in FIG. 2), which is supported in a rotatable manner by a bearing 5B, and a proximal portion (left side as viewed in FIG. 2), which is supported in a rotatable manner by a bearing 5C.

The motor mechanism 5 is located closer to an end wall 11D of the first housing 11 than the compressor mechanism 4. A stator 5D is fixed to the inner circumferential surface 11B of the first housing 11. A drive circuit (not shown) supplies the stator 5D with three-phase current. A rotor 5E is arranged in the stator 5D. The rotor 5E is fixed to the drive shaft 5A. The rotor 5E is rotated and driven by the current supplied to the stator 5D. The drive shaft 5A, stator 5D, and rotor 5E form the motor mechanism 5.

The drive circuit 6 is a known inverter circuit and includes high-voltage components such as a capacitor. The drive circuit 6 is connected to a power supply, which is installed in a vehicle, and drives the motor mechanism 5. More specifically, the drive circuit 6 converts the DC power supplied from the power supply to AC power having a certain frequency. Then, the drive circuit 6 supplies the AC power to the motor mechanism 5 and controls the rotation speed of the motor mechanism.

Referring to FIGS. 1 and 2, the drive circuit 6 drives and rotates the motor mechanism 5 to actuate the compressor mechanism 4. As a result, the compressor mechanism 4 draws refrigerant into the inner housing 10 through a suction pipe 95 and compresses the refrigerant. Then, the compressor mechanism 4 discharges the compressed refrigerant from the inner housing 10 through a discharge pipe 96.

Referring to FIG. 1, the switch valve 91 is connected to the motor-driven compressor 1 by the suction pipe 95 and the discharge pipe 96. Further, the switch valve 91 is connected to the passenger compartment exterior heat exchanger 92 by a pipe 97 and the passenger compartment interior heat exchanger 94 by a pipe 99. The expansion valve 93 is connected to the passenger compartment exterior heat exchanger 92 by a pipe 98A and the passenger compartment interior heat exchanger 94 by a pipe 98B.

The switch valve 91, which is controlled by a control unit installed in the vehicle, can switch communication states of pipes. When the switch valve 91 communicates the discharge pipe 96 and pipe 97 and communicates the suction pipe 95 and pipe 99, the refrigerant discharged from the motor-driven compressor 1 through the discharge pipe 96 flows in direction D1 as shown in FIG. 1. When the switch valve 91 communicates the discharge pipe 96 and pipe 99 and communicates the suction pipe 95 and pipe 97, the refrigerant discharged from the motor-driven compressor 1 through the discharge pipe 96 flows in direction D2 as shown in FIG. 1.

The passenger compartment exterior heat exchanger 92 dissipates heat to or absorbs heat from the ambient air. The passenger compartment interior heat exchanger 94 dissipates heat to or absorbs heat from the air in the passenger compartment. The passenger compartment exterior heat exchanger 92, the passenger compartment interior heat exchanger 94, and the expansion valve 93 are known in the art and will not be illustrated or described in detail.

The inner housing 10 and outer housing 20 of the motor-driven compressor 1 will now be described in detail.

As shown in FIG. 2, the inner housing 10 includes a sealed cavity 10A, which accommodates the compressor mechanism 4 and motor mechanism 5 in a sealed state. The inner housing 10 is generally cylindrical and elongated in the direction in which the compressor mechanism 4 and the motor mechanism 5 are arranged. The inner housing 10 may be formed from a single member or a plurality of members coupled to each other to define the sealed cavity 10A. To obtain the durability required for the inner housing 10 to endure the vibration and heat, which are generated from the compressor mechanism 4 and motor mechanism 5, and the high-temperature and high-pressure refrigerant, it is preferable that the inner housing 10 be formed from a metal, such as steel or aluminum.

The compressor mechanism 4 and the motor mechanism 5 are fixed in the sealed cavity 10A by undergoing a known fastening process, such as shrinkage fitting, pressurized fitting, or bolt fastening. A fastening structure involving such a fastening process fixes the compressor mechanism 4 and the motor mechanism 5 with high rigidity. However, it is difficult to attenuate vibration and noise generated by the compressor mechanism 4 and motor mechanism 5 with such a structure. As a result, the vibration and noise of the compressor mechanism 4 and motor mechanism 5 are easily transmitted to the inner housing 10. Heat is also easily transmitted from the compressor mechanism 4 and the motor mechanism 5 to the inner housing 10.

A suction port 15 extends through the end wall 11D of the first housing 11. A suction coupling 50, which serves as an outer pipe, is fixed to the suction port 15. A refrigerant supply passage is formed in the sealed cavity 10A between the suction port 15 and the compressor mechanism 4.

A discharge chamber 4D is defined between the first housing 11 and the second housing 12. The second housing 12 includes an end wall 12D through which a discharge port 16 extends. A discharge coupling 60, which serves as an outer pipe, is fixed to the discharge port 16.

The suction coupling 50 and discharge coupling 60 are known pipe couplings. The suction pipe 95 is coupled to the suction coupling 50. The discharge pipe 96 is coupled to the discharge coupling 60.

The outer housing 20 is generally cylindrical and elongated in the direction in which the compressor mechanism 4 and the motor mechanism 5 are arranged. The outer housing 20, which accommodates the inner housing 10, may be formed from a metal, such as steel or aluminum, a resin, or a fiber reinforced resin. The outer housing 20 includes two open ends in the longitudinal direction. The suction coupling 50 and the discharge coupling 60 respectively project outward from the two open ends. The suction coupling 50 and the discharge coupling 60 are not in contact with the outer housing 20.

The outer housing 20 includes an outer wall surface 20C. Block-shaped mounting portions 29, which can be mounted to other members, are formed on the outer wall surface 20C. The mounting portions 29 project outward in the radial direction of the outer housing 20. An insertion hole 29A extends through each mounting portion 29 parallel to the longitudinal direction of the outer housing 20. A plurality of supports 8 project from a mounting object 9, such as a frame or engine of the vehicle. The mounting portions 29 are engaged with the supports 8. Bolts 9A are fastened to the mounting portions 29 and supports 8. This fixes the motor-driven compressor 1 to the mounting object 9. The fastening structure of the mounting portions 29, supports 8, and bolts 9A fix the outer housing 20 to the mounting object 9 with high rigidity. However, as described above, it is difficult to attenuate the vibration and noise transmitted from the outer housing 20 to the mounting object 9.

In the present embodiment, intermediate members 31 and 32 are arranged between the inner housing 10 and the outer housing 20.

The intermediate members 31 and 32 are formed from different materials. More specifically, the intermediate members 31 are formed from a material having an anti-vibration material, such as rubber, elastomer, resin, fiber reinforced resin, or silicone gel. In the present embodiment, the intermediate members 31 are rubber annular bodies, or so-called O-rings. The intermediate members 31 are arranged at the two longitudinal ends of the inner housing 10 and outer housing 20 in a compressed and deformed state between an inner wall surface 20B of the outer housing 20 and an outer wall surface 11C of the first housing 11. Thus, the intermediate members 31 support the inner housing 10 in the outer housing 20.

The intermediate member 32 is formed from a material having a thermal insulation property, such as fiber mass of glass wool or the like, a foam material, cellulose fibers, or a vacuum insulation material. In the present embodiment, the intermediate member 32 is a thick sheet of glass wool. The intermediate member 32, which is wound around the outer wall surface 11C of the first housing 11, fills the void between inner wall surface 20B of the outer housing 20 and the outer wall surface 11C of the first housing 11. Thus, the intermediate member 32 supports the inner housing 10 in the outer housing 20 in a supplemental manner.

The drive circuit 6 is held by the outer wall surface 11C of the first housing 11. A third housing 13 is fixed to the outer wall surface 11C to accommodate the drive circuit 6. The third housing 13 is fastened by a bolt or the like to the outer wall surface 11C and holds the drive circuit 6 on the outer wall surface 11C. Alternatively, the drive circuit 6 may be accommodated in a recess (not shown) formed in the outer wall surface 11C of the first housing 11. In this case, a lid closes the recess to hold the drive circuit 6 in the outer wall surface 11C.

The drive circuit 6 extends from the outer wall surface 11C of the first housing 11 toward the inner wall surface 20B of the outer housing 20. A void is formed between the drive circuit 6 and the inner wall surface 20B of the outer housing 20. The void is filled with the intermediate member 32.

The outer housing 20 includes a thick portion 21, which is formed integrally with the outer housing 20, in the vicinity of the drive circuit 6. The thick portion 21 is thicker than the other parts of the outer housing 20 and projects in a trapezoidal manner from a main body 28 of the outer housing 20. When viewing the drive circuit 6 in the radial direction of the outer housing 20 from outside the outer housing 20, the thick portion 21 covers at least the entire drive circuit 6. Thus, the thick portion 21 has a higher strength than the other parts of the outer housing 20 and protects the drive circuit 6. The thick portion 21 corresponds to a protector of the present invention.

The air conditioner, to which the motor-driven compressor 1 of the first embodiment is applied, adjusts the temperature of the passenger compartment as described below.

Referring to FIG. 1, when cooling the passenger compartment, the switch valve 91 communicates the discharge pipe 96 and pipe 97 and communicates the suction pipe 95 and pipe 99. As a result, the high-temperature and high-pressure refrigerant compressed by the compressor mechanism 4 flows in direction D1. The refrigerant dissipates heat into the ambient air and liquefies at the passenger compartment exterior heat exchanger 92. Then, the pressure of the refrigerant is decreased at the expansion valve 93. Subsequently, the refrigerant absorbs heat from the air in the passenger compartment and vaporizes at the passenger compartment interior heat exchanger 94. This cools the air in the passenger compartment. The refrigerant then returns to the motor-driven compressor 1 via the pipe 99, the switch valve 91, and the suction pipe 95.

When heating the passenger compartment, the switch valve 91 communicates the discharge pipe 96 and pipe 99 and communicates the suction pipe 95 and pipe 97. As a result, the high-temperature and high-pressure refrigerant compressed by the compressor mechanism 4 flows in direction D2. The refrigerant dissipates heat into the air in the passenger compartment and liquefies at the passenger compartment interior heat exchanger 94. This heats the air in the passenger compartment. Then, the pressure of the refrigerant is decreased at the expansion valve 93. Subsequently, the refrigerant absorbs heat from the ambient air and vaporizes at the passenger compartment exterior heat exchanger 92. The refrigerant then returns to the motor-driven compressor 1 via the pipe 97, the switch valve 91, and the suction pipe 95.

In the motor-driven compressor 1 of the first embodiment, the compressor mechanism 4 and motor mechanism 5 are fixed to the inner housing 10 with high rigidity. Further, the mounting portions 29, the supports 8, and the bolts 9A fix the outer housing 20 to the mounting object 9 with high rigidity. Thus, if the transmission of vibration and noise cannot be suppressed between the inner housing 10 and the outer housing 20, the vibration and noise from the compressor mechanism 4 and motor mechanism 5 would be transmitted from the inner housing 10 and outer housing 20 to the mounting object 9 without being attenuated. This may adversely affect comfort in the environment of the passenger compartment. Further, if the transmission of heat between the inner housing 10 and outer housing 20 cannot be suppressed, the heat of the high-temperature and high-pressure refrigerant compressed by the compressor mechanism 4 would be dissipated to the exterior through the outer housing 20.

In this regard, the motor-driven compressor 1 of the first embodiment includes the intermediate members 31 and 32, which have anti-vibration and thermal insulation properties and which are arranged between the inner housing 10 and the outer housing 20. Since the intermediate members 31 have an anti-vibration property, the transmission of vibration and noise, generated by the compressor mechanism 4 and motor mechanism 5, from the inner housing 10 to the outer housing 20 and mounting object 9 is suppressed. The intermediate members 32, which are formed from glass wool, also suppress the transmission of vibration and noise from the inner housing 10 to the outer housing 20.

Further, the intermediate member 32 has a thermal insulation property. Thus, the heat of the high-temperature and high-pressure refrigerant compressed by the compressor mechanism 4 is not transmitted from the inner housing 10 to the intermediate member 32 and the outer housing 20. Further, the intermediate members 31, which are formed from rubber, also suppress the transmission of the heat of the refrigerant. Thus, the motor-driven compressor 1 prevents the heat from decreasing in the drawn in refrigerant and the discharged refrigerant. Accordingly, when the air conditioner functions as a heat pump and heats the passenger compartment, the temperature of the refrigerant flowing to the passenger compartment interior heat exchanger 94 can be increased. As a result, the passenger compartment interior heat exchanger 94 effectively dissipates heat to the air in the passenger compartment and exhibits sufficient heating performance.

The first embodiment also has the advantages described below.

The intermediate member 32 is arranged between the drive circuit 6 and the outer housing 20. The outer housing 20 accommodates the inner housing 10, which holds the drive circuit 6 and includes the thick portion 21, which protects the drive circuit 6 from external impacts. The thick portion 21 is located at the part of the outer housing 20 that is in the vicinity of the drive circuit 6. Thus, referring to FIG. 2, during a vehicle collision, even when a nearby object F, such as an engine, interferes with the motor-driven compressor 1, the thick portion 21 ensures protection of the drive circuit 6 and prevents the object F from affecting the drive circuit 6. Further, the intermediate member 32 absorbs impacts applied toward the drive circuit 6. As a result, the motor-driven compressor 1 prevents damage of high-voltage components in the drive circuit 6 and ensures prevention of electric leakage from the drive circuit 6.

The intermediate members 31, which are arranged between the outer housing 20 and the inner housing 10, have an anti-vibration property. Thus, the transmission of vibration and noise, which are generated by the compressor mechanism 4 and motor mechanism 5, to the thick portion 21 of the outer housing 20 is suppressed. As a result, the motor-driven compressor 1 prevents the thick portion 21 from being resonated by the vibration from the compressor mechanism 4 and the motor mechanism 5. This prevents the thick portion 21 from being the generation origin of noise.

Accordingly, the motor-driven compressor 1 of the first embodiment prevents electric leakage from the drive circuit 6 while suppressing the generation of noise.

The thick portion 21 can be easily obtained by forming a ridge on the outer wall surface 20C when molding the outer housing 20. Thus, in contrast to when fixing a discrete protector to the outer housing 20, the motor-driven compressor 1 simplifies the outer housing 20 and reduces the number of components. Further, the thick portion 21 is formed integrally with the outer housing 20. Thus, in contrast to when fixing a discrete protector to the outer housing 20, the thick portion 21 is not resonated by vibration from the vehicle, such as the engine, and does not generate noise.

The thick portion 21 projects outward in the radial direction from the outer housing 20. This simplifies the form of the inner side of the outer housing 20 and facilitates coupling to the inner housing 10.

Second Embodiment

Figure 3:
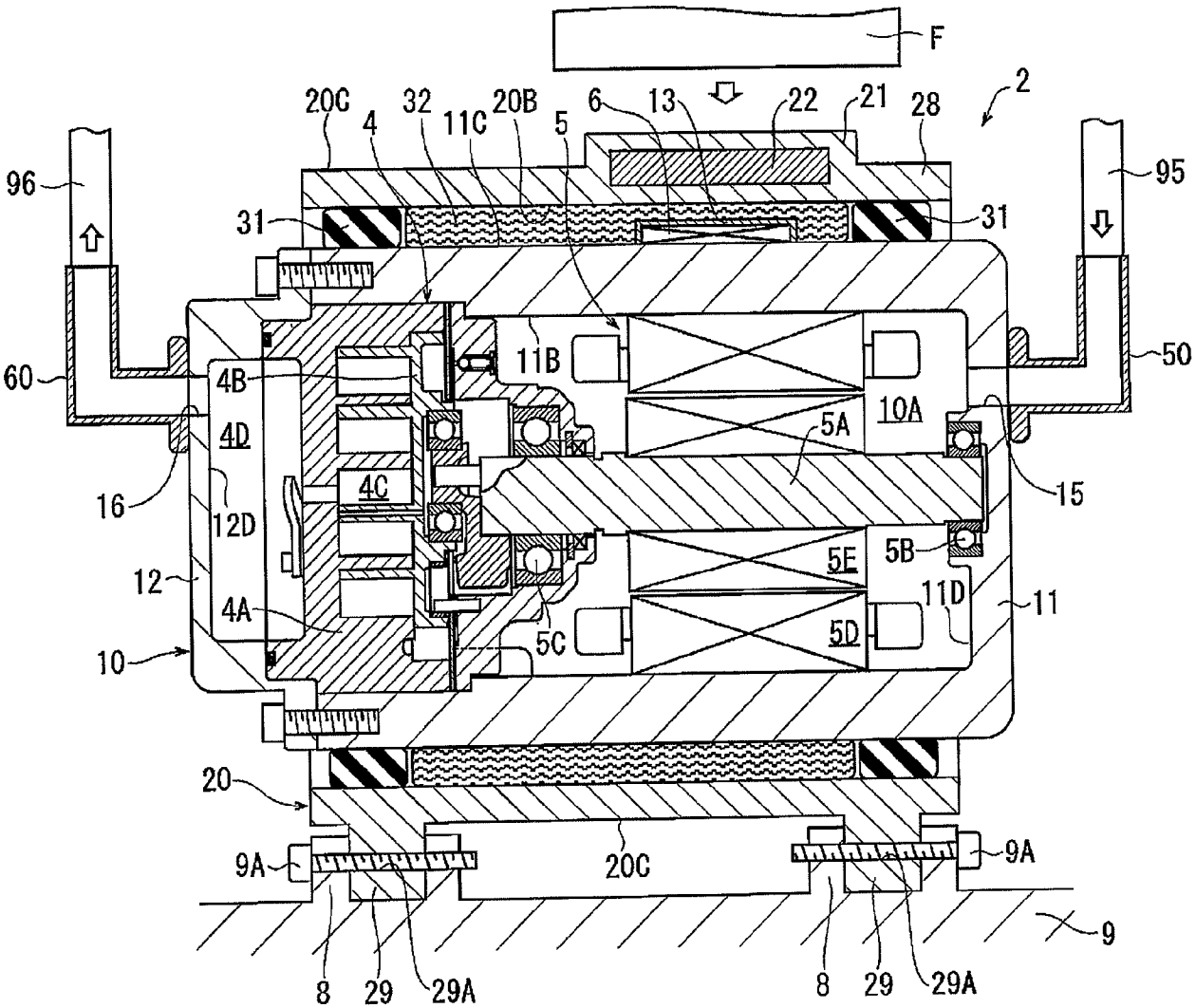
FIG. 3 is a cross-sectional view of a motor-driven compressor according to a second embodiment of the present invention.

Referring to FIG. 3, a motor-driven compressor 2 of the second embodiment includes a high-strength member 22, which is arranged in the thick portion 21 of the first embodiment. Otherwise, the motor-driven compressor 2 has the same structure as the motor-driven compressor 1 of the first embodiment. Like or same reference numerals are given to those components that are the same as the corresponding components of the first embodiment. Such components will not be described in detail.

The high-strength member 22 is a generally plate-shaped member formed from a material having higher strength than the material of the outer housing 20. For example, when the outer housing 20 is formed from a metal material such as iron or aluminum, the high-strength member 22 is formed from a material having a higher strength such as steel or an alloy. In this case, the high-strength member 22 is casted integrally with the outer housing 20. When the outer housing 20 is formed from a resin material, the high-strength member 22 is formed from a material having a higher strength such as fiber-reinforced resin or metal. In this case, the high-strength member 22 is insert-molded and formed integrally with the main body 28 of the outer housing 20. In the present embodiment, the high-strength member 22 is entirely encompassed by the outer housing 20. That is, the high-strength member 22 is embedded in the outer housing 20.

When viewing the drive circuit 6 from the outside of the outer housing 20 in the radial direction of the outer housing 20, the high-strength member 22 covers the entire drive circuit 6. Thus, the part of the outer housing 20 in which the high-strength member 22 is arranged has a higher strength than the other parts of the outer housing 20. In the same manner as the thick portion 21, the high-strength member 22 protects the drive circuit 6 and corresponds to a protector of the present invention.

In the same manner as the motor-driven compressor 1 of the first embodiment, the motor-driven compressor 2 of the second embodiment suppresses the generation of noise with the thick portion 21 and the high-strength member 22 and ensures prevention of electric leakage from the drive circuit 6.

The second embodiment has the advantages described below.

The high-strength member 22 is embedded in and integrated with the outer housing 20. This ensures that the high-strength member 22 is integrated with the outer housing 20. In contrast to when a discrete protector is fixed to the outer housing 20, the outer housing 20 is simplified, and the number of components is reduced. Further, since the high-strength member 22 is integrated with the outer housing 20, in contrast to when a discrete protector is fixed to the outer housing 20, the high-strength member 22 is not resonated by vibration from the vehicle, such as the engine, and does not generate noise.

The material of the high-strength member 22 has a higher strength than the material of the outer housing 20. Thus, the thickness of the thick portion 21 can be decreased while ensuring the strength required for protection of the drive circuit 6. This allows the difference in thickness between the thick portion 21 and other parts of the outer housing 20 to be decreased or eliminated. As a result, the present embodiment allows the outer housing 20 to be smaller than that of the motor-driven compressor 1 of the first embodiment.

Third Embodiment

Figure 4:
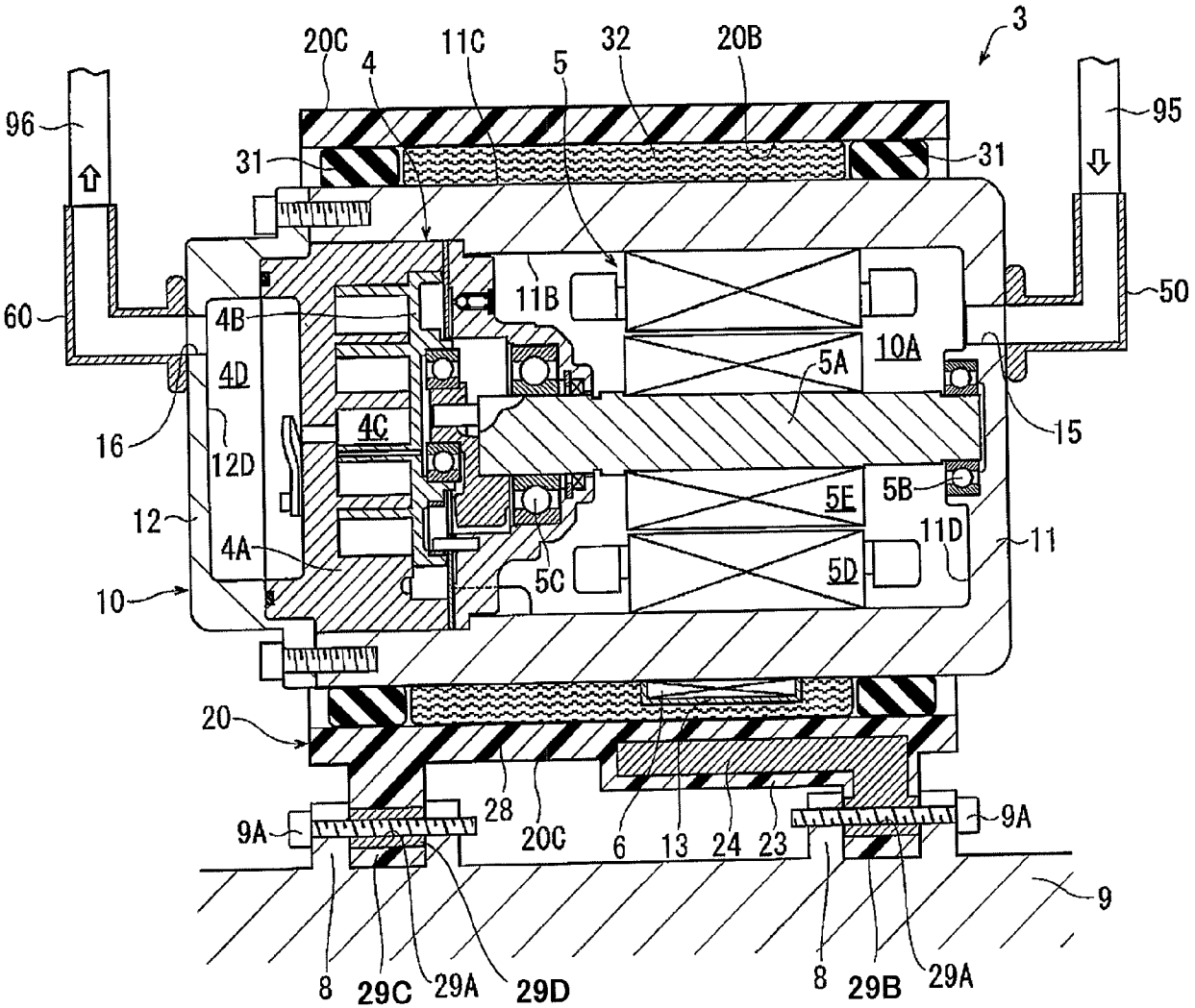
FIG. 4 is a cross-sectional view of a motor-driven compressor according to a third embodiment of the present invention.

Referring to FIG. 4, the motor-driven compressor 3 of the third embodiment differs from the motor-driven compressor 1 of the first embodiment in the following points. The drive circuit 6 is held by the outer wall surface 11C of the inner housing 10 at a location facing the mounting object 9. The outer housing 20 is formed from a resin. The outer housing 20 includes a thick portion 23 instead of the thick portion 21. A high-strength member 24 is arranged in the thick portion 23. The outer housing 20 includes mounting portions 29B and 29C in lieu of the mounting portions 29. Otherwise, the motor-driven compressor 3 has the same structure as the motor-driven compressor 1 of the first embodiment. Like or same reference numerals are given to those components that are the same as the corresponding components of the first embodiment. Such components will not be described in detail.

The thick portion 23 is formed on the part of the resin outer housing 20 located in the vicinity of the drive circuit 6. The thick portion 23 is thicker than other parts of the outer housing 20 and projects in a trapezoidal manner from the main body 28 of the outer housing 20. When viewing the drive circuit 6 from the outside of the outer housing 20 in the radial direction of the outer housing 20, the thick portion 23 covers at least the entire drive circuit 6. Thus, the thick portion 23 has a higher strength than the other parts of the outer housing 20 and protects the drive circuit 6. The thick portion 23 corresponds to a protector of the present invention.

The high-strength member 24 is arranged in the thick portion 23. The high-strength member 24 is generally plate-shaped and formed from a material having a higher strength than resin, such as a fiber reinforced resin or metal. The high-strength member 24 is insert-molded and formed integrally with the main body 28 of the outer housing 20. When viewing the drive circuit 6 from the outside of the outer housing 20 in the radial direction of the outer housing 20, the high-strength member 24 covers at least the entire drive circuit 6. Thus, the part of the outer housing 20 in which the high-strength member 24 is arranged has a higher strength than other parts of the outer housing 20. In the same manner as the thick portion 23, the high-strength member 24 protects the drive circuit 6 and corresponds to a protector of the present invention.

The part of the outer housing 20 in which the high-strength member 24 is arranged includes a block-shaped mounting portion 29B, which projects outward in the radial direction from the outer wall surface 20C. The high-strength member 24 includes one end formed integrally with the mounting portion 29B.

A block-shaped mounting portion 29C, which projects in the same direction as the mounting portion 29B, is formed on the outer housing 20 at a location separated from the mounting portion 29B. A protective member 29D, which is formed from the same material as the high-strength member 24, is insert-molded in the mounting portion 29C.

An insertion hole 29A extends through each of the mounting portions 29B and 29C. The mounting portions 29B and 29C are engaged with the supports 8. In this state, the bolts 9A fasten the mounting portions 29B and 29C and the supports 8. This fixes the mounting portions 29B and 29C to the mounting object 9. Such fastening structure formed by the mounting portions 29B and 29C, the supports 8, and the bolts 9A fix the resin outer housing 20 to the mounting object 9 with high rigidity.

In the same manner as the motor-driven compressors 1 and 2 of the first and second embodiments, the thick portion 23 and high-strength member 24 in the motor-driven compressor 3 of the third embodiment suppresses the generation of noise and ensures prevention of electric leakage from the drive circuit 6.

The third embodiment has the advantages described below.

The high-strength member 24 is formed integrally with the mounting portion 29B. This improves the strength of the mounting portion 29B, which is arranged on the outer housing 20, and ensures prevention of damage to the mounting portion 29B.

The outer housing 20 is formed from a resin having superior anti-vibration and thermal insulation properties. This further enhances the advantages of the present invention.

It should be apparent to those skilled in the art that the present invention may be embodied in many other specific forms without departing from the spirit or scope of the invention. Particularly, it should be understood that the present invention may be embodied in the following forms.

Figure 5:
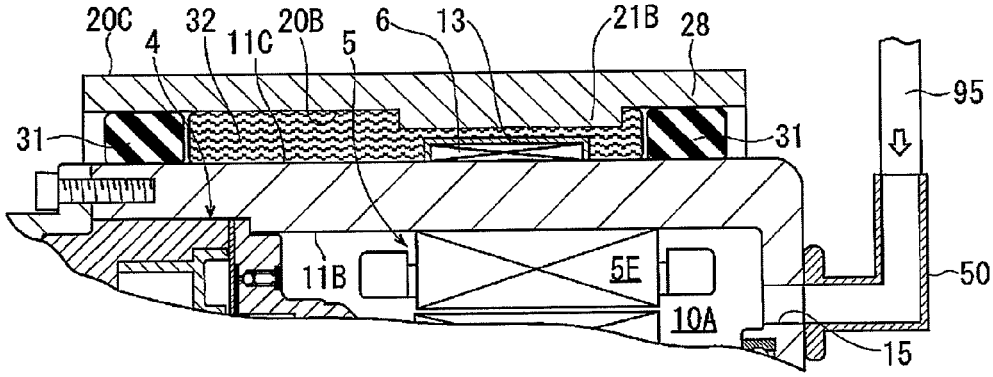
FIG. 5 is a cross-sectional view of a modified example of a motor-driven compressor according to the present invention.

Instead of the trapezoidal thick portion 21 of the first embodiment, a plurality of ribs, serving as a protector, may project outward in the radial direction from the outer wall surface 20C of the outer housing 20. Further, as shown in FIG. 5, a thick portion 21B may project inward in the radial direction from the inner wall surface 20B of the outer housing 20. This simplifies the form of the outer side of the outer housing 20 and reduces interference with other components when installing the motor-driven compressor in a vehicle or the like.

Figure 6A:
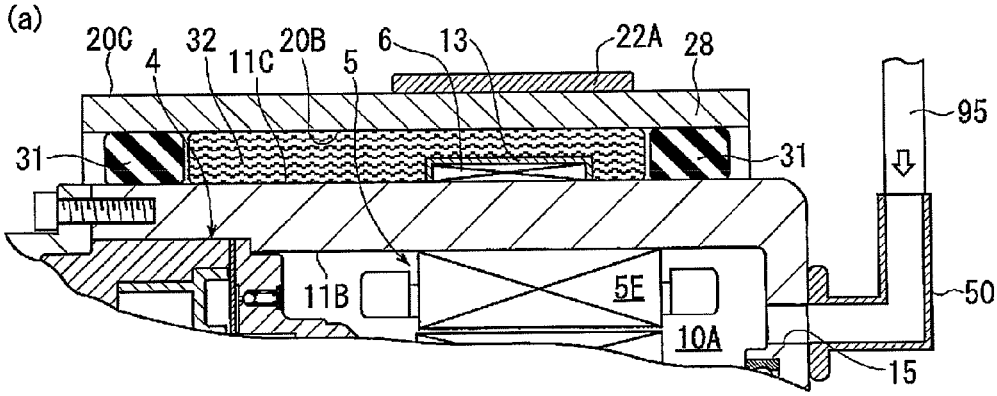
FIGS. 6A and 6B are cross-sectional views of a modified example of a motor-driven compressor according to the present invention.
Figure 6B:
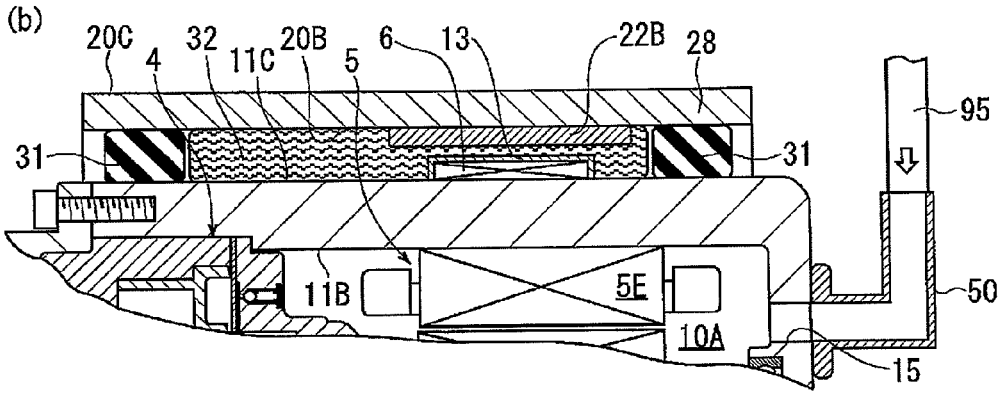

Instead of the thick portion 21 of the first embodiment, as shown in FIG. 6(*a*), a generally plate-shaped high-strength member 22A having higher strength than the main body 28 and serving as a protector may be adhered to the outer wall surface 20C of the outer housing 20. Further, as shown in FIG. 6(*b*), a generally plate-shaped high-strength member 22B having higher strength than the main body 28 and serving as a protector may be adhered to inner wall surface 20B of the outer housing 20. In such cases, the high-strength members 22A and 22B can easily be fixed to the outer housing 20.

The fastening structure and shapes of the mounting portions 29, 29B, and 29C, the supports 8, and the bolts 9A are not limited to those of the above embodiments. Any structure can be employed as long as the mounting portions 29, 29B, and 29C can fix the motor-driven compressors 1, 2 and 3 to the mounting object 9.

Instead of the intermediate members 31 and 32, any single member having anti-vibration and thermal insulation properties may be used as an intermediate member.

The compressor mechanism 4 is not limited to a scroll type and may be of a reciprocating type, a vane type, or any other known compression type.

The present examples and embodiments are to be considered as illustrative and not restrictive, and the invention is not to be limited to the details given herein, but may be modified within the scope and equivalence of the appended claims.

The invention claimed is:

1. A motor-driven compressor comprising:

a compressor mechanism, disposed in a vehicle, that compresses a refrigerant;

a motor mechanism that actuates the compressor mechanism, the motor mechanism including a rotatable drive shaft;

a drive circuit configured to drive the motor mechanism, wherein the drive circuit is connected to a power supply so as to supply power to the motor mechanism and control a rotation speed of the motor mechanism to actuate the compressor mechanism;

an inner housing that accommodates the compressor mechanism and the motor mechanism in a sealed state and holds the drive circuit;

an outer housing that accommodates the inner housing so that the inner housing is disposed in the outer housing, wherein the outer housing includes a mounting portion that can be mounted to another member;

an intermediate member that supports the inner housing, arranged between the inner housing and the outer housing, and including anti-vibration properties, and between the drive circuit and the outer housing, and including thermal insulation properties; and a protector that protects the drive circuit from an external impact, wherein the protector is arranged on the outer housing, wherein, one part of the motor driven compressor is configured to include the inner housing, the drive circuit, the intermediate member and the protector arranged in recited order in a radially outward direction from the drive shaft, and another part of the motor driven compressor is configured to include the inner housing, the intermediate member and the outer housing arranged in the radially outward direction from the drive shaft.

2. The motor-driven compressor according to claim 1, wherein the protector is located at a part of the outer housing that is in the vicinity of the drive circuit.

3. The motor-driven compressor according to claim 1, wherein the protector includes a thick portion formed integrally with the outer housing.

4. The motor-driven compressor according to claim 3, wherein the outer housing is cylindrical, and the thick portion projects from the outer housing inward or outward in a radial direction of the outer housing.

5. The motor-driven compressor according to claim 1, wherein the protector is formed integrally with the outer housing and includes a high-strength member having a higher strength than the outer housing.

6. The motor-driven compressor according to claim 5, wherein the high-strength member is embedded in the outer housing.

7. The motor-driven compressor according to claim 5, wherein the high-strength member is formed integrally with the mounting portion.

8. The motor-driven compressor according to claim 1, wherein the protector is adhered to an inner wall surface or outer wall surface of the outer housing and includes a high-strength member having higher strength than the outer housing.

9. The motor-driven compressor according to claim 1, wherein the outer housing is formed from resin or fiber reinforced resin.

* * * * *